US010633827B2

(12) United States Patent
Hunold et al.

(10) Patent No.: US 10,633,827 B2
(45) Date of Patent: Apr. 28, 2020

(54) TEMPERATURE RESPONSIVE HYDRAULIC DERATE

(71) Applicant: Deere & Company, Moline, IL (US)

(72) Inventors: Brent M. Hunold, Dubuque, IA (US); Cory D. Wyand, Dubuque, IA (US); Kristen D. Cadman, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 229 days.

(21) Appl. No.: 15/785,061

(22) Filed: Oct. 16, 2017

(65) Prior Publication Data

US 2019/0112787 A1 Apr. 18, 2019

(51) Int. Cl.

| | |
|---|---|
| ***E02F 9/22*** | (2006.01) |
| ***E02F 9/20*** | (2006.01) |
| ***E02F 3/32*** | (2006.01) |
| ***E02F 3/42*** | (2006.01) |
| ***F15B 21/04*** | (2019.01) |
| ***F15B 21/08*** | (2006.01) |
| ***F01P 3/20*** | (2006.01) |

(Continued)

(52) U.S. Cl.

CPC ..... *E02F 9/2235* (2013.01); *E02F 3/32* (2013.01); *E02F 3/425* (2013.01); *E02F 9/2025* (2013.01); *E02F 9/2271* (2013.01); *F01P 3/20* (2013.01); *F15B 21/042* (2013.01); *F15B 21/08* (2013.01); *E02F 9/2296* (2013.01); *F01P 11/029* (2013.01); *F01P 2025/32* (2013.01); *F15B 11/08* (2013.01); *F15B 13/0401* (2013.01); *F15B 2211/20523* (2013.01); *F15B 2211/20546* (2013.01); *F15B 2211/255* (2013.01); *F15B 2211/62* (2013.01); *F15B 2211/6343* (2013.01); *F15B 2211/66* (2013.01); *F15B 2211/6652* (2013.01); *F15B 2211/7051* (2013.01)

(58) Field of Classification Search

CPC ..... E02F 9/2235; E02F 9/2025; E02F 9/2271; E02F 3/32; E02F 3/425; F01P 3/20; F15B 21/042; F15B 21/08

USPC ..... 60/456; 91/517

See application file for complete search history.

(56) References Cited

U.S. PATENT DOCUMENTS 4,488,680 A * 12/1984 Itoh ..... G05D 23/132 236/100

4,904,161 A * 2/1990 Kamide ..... E02F 9/2235 417/218

(Continued)

*Primary Examiner* — Nathaniel E Wiehe

*Assistant Examiner* — Richard C Drake

(74) *Attorney, Agent, or Firm* — Michael Best & Friedrich LLP

(57) ABSTRACT

A work machine includes a mechanical arm and a hydraulic actuator coupled to the mechanical arm to move the arm between a first position and a second position. A valve is in fluid communication with the hydraulic actuator for supplying fluid to the hydraulic actuator. A pump is configured to discharge fluid to the valve. An engine is operatively connected to the pump. A coolant system is in thermal communication with the engine and includes a temperature sensor. A controller is in communication with the pump and the temperature sensor. The controller is configured to transmit a control signal to the pump to modify a flowrate of the pump and to adjust the flowrate of the pump in response to a signal from the temperature sensor that a temperature is at or above a set temperature value.

19 Claims, 6 Drawing Sheets

| Engine Coolant Temperature | Hydraulic Flow command |
|---|---|
| °C | (% of request) |
| ≤X | 100% |
| X+1 | 99% |
| X+2 | 98% |
| X+3 | 97% |
| X+4 | 96% |
| X+5 | 95% |
| X+6 | 94% |
| X+7 | 93% |
| X+8 | 92% |
| X+9 | 91% |
| ≥X+10 | 90% |

(51) Int. Cl.

| | |
|---|---|
| ***F15B 21/042*** | (2019.01) |
| *F15B 11/08* | (2006.01) |
| *F15B 13/04* | (2006.01) |
| *F01P 11/02* | (2006.01) |

(56) References Cited

U.S. PATENT DOCUMENTS

| | | | | |
|---|---|---|---|---|
| 5,251,440 | A * | 10/1993 | Bong-dong | E02F 9/226 60/329 |
| 5,352,095 | A * | 10/1994 | Tanaka | E02F 9/2246 417/12 |
| 7,614,223 | B2 * | 11/2009 | St. Aubin | F15B 21/042 60/327 |
| 7,827,785 | B2 * | 11/2010 | Messerlie | F16K 49/00 60/329 |
| 8,234,860 | B2 * | 8/2012 | Beschorner | E02F 9/2235 60/329 |
| 9,790,965 | B2 * | 10/2017 | Joung | F15B 11/0423 |
| 9,803,665 | B2 * | 10/2017 | Beschorner | F15B 21/042 |
| 9,920,778 | B2 * | 3/2018 | Bosch | F04D 25/02 |
| 2016/0145835 | A1 * | 5/2016 | Kim | F15B 11/042 60/327 |

* cited by examiner

| Engine Coolant Temperature | Hydraulic Flow command |
|---|---|
| °C | (% of request) |
| ≤X | 100% |
| X+1 | 99% |
| X+2 | 98% |
| X+3 | 97% |
| X+4 | 96% |
| X+5 | 95% |
| X+6 | 94% |
| X+7 | 93% |
| X+8 | 92% |
| X+9 | 91% |
| ≥X+10 | 90% |

FIG. 6

TEMPERATURE RESPONSIVE HYDRAULIC DERATE

FIELD

The disclosure relates to a hydraulic system for a work vehicle.

BACKGROUND

Many industrial work machines, such as construction equipment, use hydraulics to control various moveable implements. The operator is provided with one or more input or control devices operably coupled to one or more hydraulic actuators, which manipulate the relative location of select components or devices of the equipment to perform various operations. For example, excavators often have a plurality of control levers or joysticks and foot pedals to control the position of a boom arm, a position of a dipper arm coupled to the boom arm, and a position of a bucket coupled to a dipper arm. Movement of the controls adjusts the flow of hydraulic fluid to cylinders connected to the different components.

SUMMARY

According to an exemplary embodiment, a work machine includes a mechanical arm and a hydraulic actuator coupled to the mechanical arm to move the arm between a first position and a second position. A valve is in fluid communication with the hydraulic actuator for supplying fluid to the hydraulic actuator. A pump is configured to discharge fluid to the valve. An engine is operatively connected to the pump. A coolant system is in thermal communication with the engine and includes a temperature sensor. A controller is in communication with the pump and the temperature sensor. The controller is configured to transmit a control signal to the pump to modify a flowrate of the pump and to adjust the flowrate of the pump in response to a signal from the temperature sensor that a temperature is at or above a set temperature value.

According to another exemplary embodiment, a work machine includes a mechanical arm and a hydraulic actuator coupled to the mechanical arm to move the arm between a first position and a second position. A valve is in fluid communication with the hydraulic actuator for supplying fluid to the hydraulic actuator. A pump is configured to discharge fluid to the valve. An engine is operatively connected to the pump. A coolant system is in thermal communication with the engine and includes a temperature sensor. A controller is in communication with the pump and the temperature sensor. The controller is configured to transmit a control signal to the pump to modify a flowrate of the pump, and is configured to adjust the flowrate of the pump between approximately 1 percent and approximately 10 percent in response to a signal from the temperature sensor that a temperature is at or above a set temperature value.

Another exemplary embodiment is directed to a method of reducing operating temperature of a work machine. The work machine includes an engine, a coolant system, a temperature sensor, a hydraulic actuator, a hydraulic pump, and a controller for controlling the flow of the hydraulic pump. A flow request for the hydraulic pump is received. The flow request is converted to a pump displacement request associated with a hydraulic flow rate. A temperature value is received from the temperature sensor. The pump displacement request is modified when the temperature value is at or above a set temperature value to adjust the hydraulic flow. The adjusted pump displacement request is converted to a pump control signal. The pump control signal is output to the hydraulic pump.

BRIEF DESCRIPTION OF THE DRAWINGS

The aspects and features of various exemplary embodiments will be more apparent from the description of those exemplary embodiments taken with reference to the accompanying drawings, in which:

FIG. 6 is a lookup table for the hydraulic flow derate.

DETAILED DESCRIPTION OF EXEMPLARY EMBODIMENTS

Figure 1:
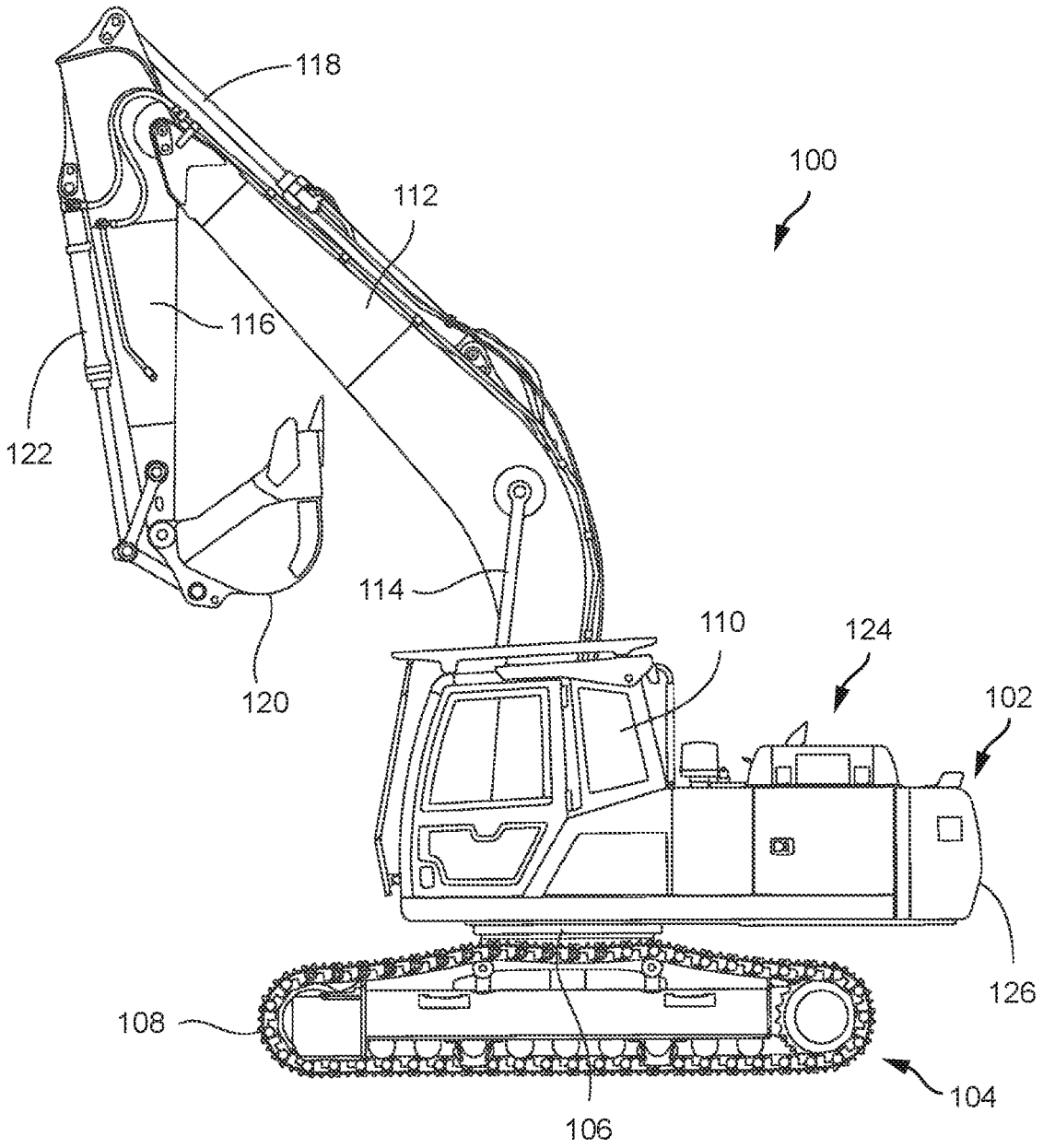
FIG. 1 is a side view of an industrial machine.

FIG. 1 illustrates an exemplary embodiment of a work machine depicted as an excavator 100. The present disclosure is not limited, however, to an excavator and may extend to other industrial machines such as a loader, crawler, harvester, skidder, backhoe, feller buncher, motor grader, or any other work machine. As such, while the figures and forthcoming description may relate to an excavator, it is to be understood that the scope of the present disclosure extends beyond an excavator and, where applicable, the term "machine" or "work machine" will be used instead. The term "machine" or "work machine" is intended to be broader and encompass other vehicles besides an excavator for purposes of this disclosure.

The excavator 100 includes a chassis comprising an upper frame 102 pivotally mounted to an undercarriage 104 by means of a swing pivot 106. The upper frame 102 is rotatable about 360 degrees relative to the undercarriage 104 on the swing pivot 106. A hydraulic motor (not shown) drives a gear train (not shown) for pivoting the upper frame 102 about the swing pivot 106.

The undercarriage 104 includes a pair of ground-engaging mechanisms such as tracks 108 on opposite sides of the undercarriage 104 for moving along the ground. Alternatively, the excavator 100 includes more than two tracks or wheels for engaging the ground. The upper frame 102 includes a cab no in which the operator controls the machine. The cab no has a control system (not shown) including, but not limited to, different combinations of a steering wheel, a control level, a joystick, control pedals, and control buttons. The operator actuates one or more controls of the control system for purposes of operating the excavator 100.

The excavator 100 also includes a boom 112 that extends from the upper frame 102 adjacent to the cab no. The boom 112 is rotatable about a vertical arc by actuation of a pair of boom cylinders 114. A dipper stick or arm 116 is rotatably mounted at one end of the boom 112 and its position is controlled by a hydraulic cylinder 118. The dipper stick or arm 116 is rotatably coupled to a work implement, for example a bucket 120 that is pivotable relative to the arm 116 by means of a hydraulic cylinder 122.

The upper frame 102 of the machine 100 includes an outer shell cover 124 over an engine assembly. The upper frame 102 also includes a counterweight body 126 comprising a housing filled with material to add weight to the machine and offset a load collected in the bucket 120. The offset weight 126 improves the craning or digging performance characteristics of the excavator 100.

Figure 2:
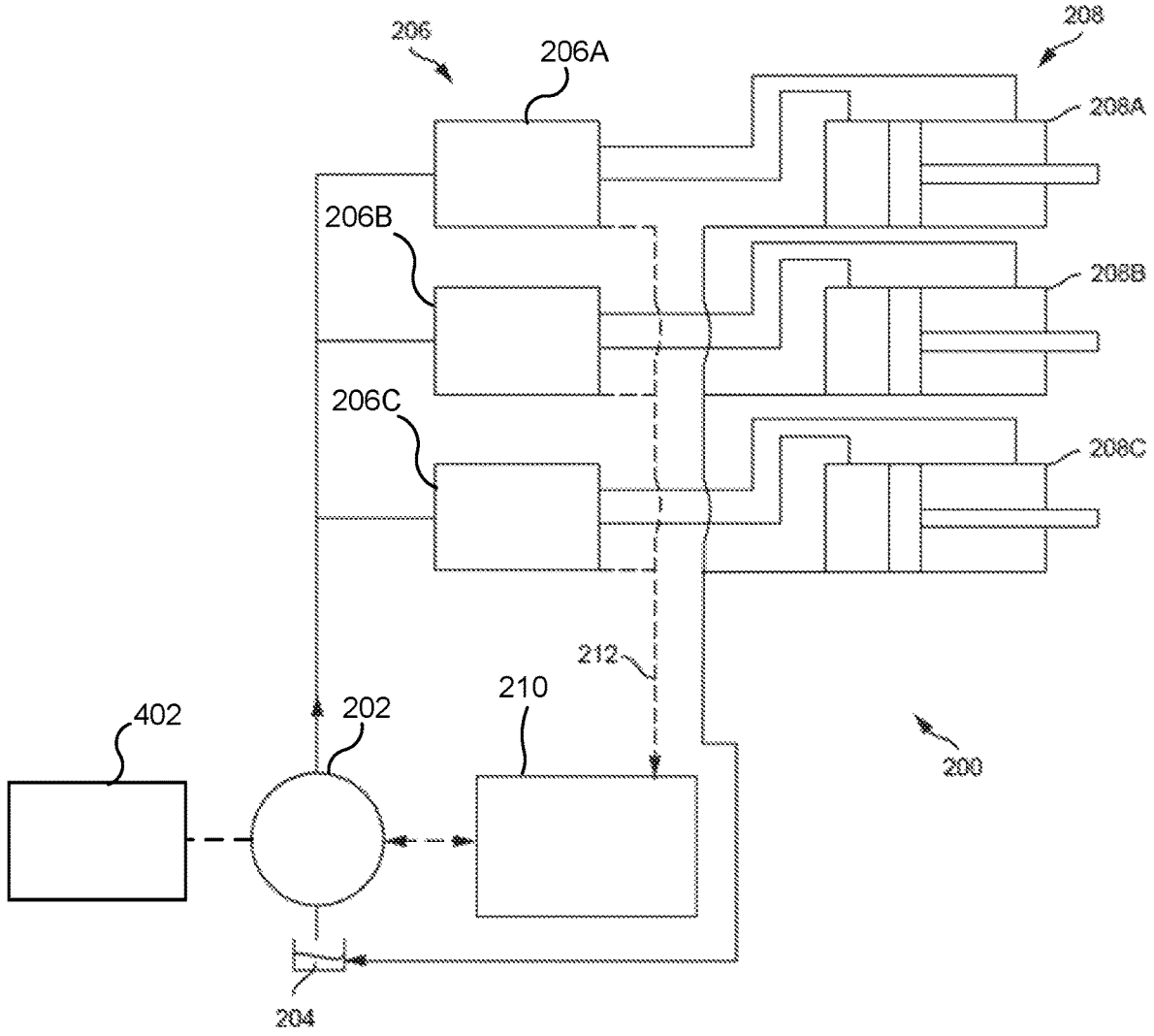
FIG. 2 is a schematic of a portion of an exemplary hydraulic system for the industrial machine of FIG. 1.

FIG. 2 illustrates a partial schematic of an exemplary embodiment of a hydraulic system 200 configured to supply fluid to implements in the excavator 100 shown in FIG. 1, although it can be adapted be used with other work machines as mentioned above. A basic layout of a portion of the hydraulic system 200 is shown for clarity and one of ordinary skill in the art will understand that different hydraulic, mechanical, and electrical components can be used depending on the machine and the moveable implements.

The hydraulic system 200 includes at least one pump 202 that receives fluid, for example hydraulic oil, from a reservoir 204 and supplies fluid to one or more downstream components at a desired system pressure. For example, the pump 202 is in fluid communication with one or more valves 206, and each valve is in fluid communication with at least one respective actuator 208A, 208B, 208C. The actuators 208 represent the actuators 114, 118, 122 described with the reference to FIG. 1

The pump 202 is capable of providing an adjustable output and may be in the form of, for example, a variable displacement pump or variable delivery pump. The pump 202 adjusts the pressure of the fluid supplied to the valves 206, and the valves 206 control the fluid flow to the actuators 208. Although only a single pump 202 is shown, two or more pumps may be used depending on the requirements of the system.

The output of the pump 202 is determined by a controller 210. In an exemplary embodiment the controller 210 is an Vehicle Control Unit ("VCU"), although other suitable controllers can also be used, and includes a memory for storing software, logic, algorithms, programs, a set of instructions, etc. for controlling the excavator 100. The controller 210 also includes a processor for carrying out or executing the software, logic, algorithms, programs, set of instructions, etc. stored in the memory. The memory can store look-up tables, graphical representations of various functions, and other data or information for carrying out or executing the software, logic, algorithms, programs, set of instructions, etc. and controlling the excavator 100.

The controller 210 is in communication with the pump 202 and configured to send a control signal to the pump 202 to adjust the output or flowrate. The type of control signal and how the pump 202 is adjusted will vary depending on the system. For example, a control signal can be sent from the controller 210 directly to the pump 202 or a to a separate pump controller. The control signal can be electrical, hydraulic, mechanical, or any combination thereof. In an exemplary embodiment, the pump 202 includes a hydraulic control unit that receives the control signal from the controller 210 and adjusts a valve that controls the flow of the fluid exiting the pump 202. Specifically, the hydraulic control unit may include an adjustable flow valve, for example a solenoid valve whose output is modified by the current in the control signal. While the hydraulic control unit may be incorporated into or positioned separately from the pump, the use of the term pump in this disclosure is meant to cover both layouts as well as other available pump layouts as would be understood by one of ordinary skill in the art.

The type and number of valves 206 used depends on the type of actuator 208 and the type of machine. The exemplary embodiment depicted in FIG. 2 shows three valves 206A, 206B, 206C. The valves 206 are configured to receive a signal from a controller and/or one or more control devices to selectively supply fluid to the actuators 208. A basic schematic of the valves 206A, 206B, 206C is shown for clarity and one of ordinary skill in the art will understand that the valves 106 can comprise a system of one or more different types of valves, sensors, comparators, switches, regulators, and other hydraulic components including spool valves, check valves, solenoids, etc., that are controlled by various hydraulic, mechanical, or electric signals.

The actuators 208 can be similar to, or may be any other suitable type of hydraulic actuator known to one of ordinary skill in the art. FIG. 2 shows an exemplary embodiment of three double-acting hydraulic actuators 208A, 208B, 208C. Each of the double-acting actuators 208 includes a first chamber and a second chamber and is configured to selectively receive fluid in the first or second chamber via the associated valve 206 in order to move the actuator in a corresponding direction. The actuators 208 are in fluid communication with the reservoir 204 so that fluid exiting one of the first or second chambers of each actuator 208 drains to the reservoir 204.

During operation, (i.e. movement and use of the bucket 120) the load requirements for the actuators 208 can vary and the hydraulic system 200 can be pressure compensated for these variable loads through a load sensing system 212. The load sensing system 212 determines the load requirements of one or more of the actuators and creates a load pressure value that is used to adjust the pump 202 output. In an exemplary embodiment, a load sensing component (not shown) is associated with each of the valves 206 to measure the load, or pressure requirements, on the valves 206 from the actuators 208. The load sensing components can be incorporated into the valves 206 or in communication therewith. For example, the load sensing component can include one or more shuttle valves or isolator valves (not shown) in communication with the main valves 206 and configured to relay the highest pressure requirement for the three actuators 208 to the controller 210. The load sensing components can utilize other hydraulic, mechanical, electrical, and/or electromechanical devices and methods to determine and output the load pressure value to the controller 210.

Figure 3:
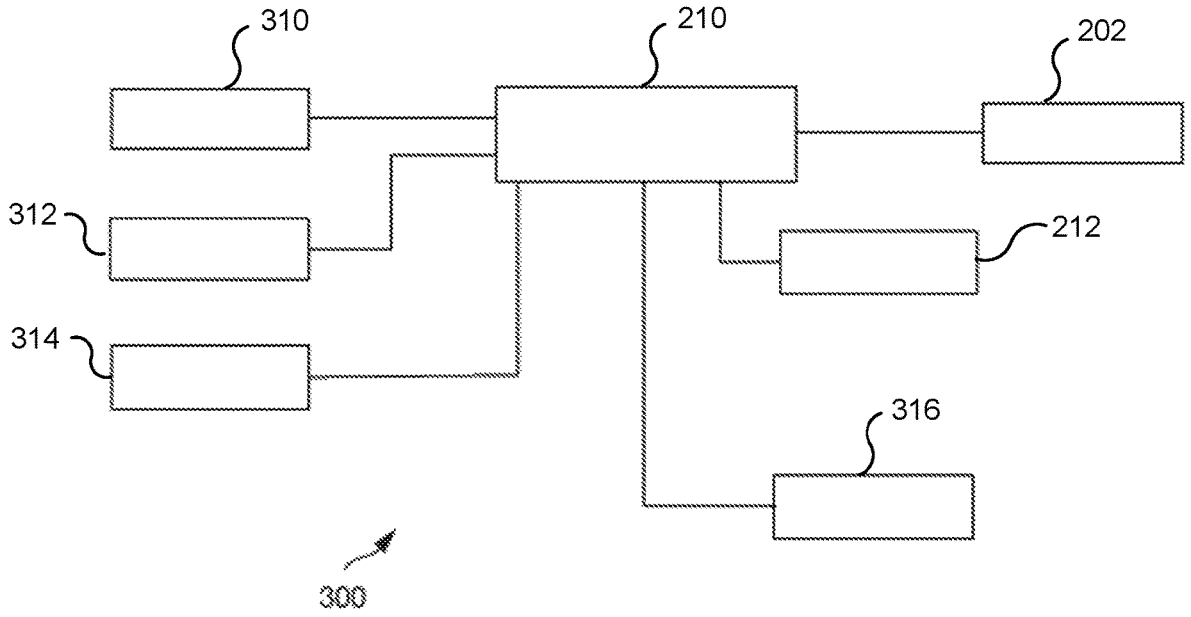
FIG. 3 is a schematic of a portion of an exemplary control system for the industrial machine of FIG. 1.

FIG. 3 illustrates an exemplary control schematic 300 of the controller 210. The controller 210 includes a plurality of inputs and outputs that are used to receive and transmit information and commands to and from different components in the excavator 100. Communication between the controller 210 and the different components can be accomplished through a CAN bus or other communication link (e.g., wireless transceivers). Other conventional communication protocols may include J1587 data bus, J1939 data bus, IESCAN data bus, etc. A basic layout of a portion of the control schematic 300 is shown for clarity and one of ordinary skill in the art will understand that different inputs and outputs can be associated with the controller 210.

The controller 210 is in communication with one or more sensors 310. Although represented as a single unit, the controller 210 is typically in communication with a plurality of sensors to gather and compile information about the operation of the vehicle. The sensors 310 can monitor vehicle speed, vehicle position, and other vehicle or engine specific variables.

The controller 210 can also be in communication with one or more operator input mechanisms 312. The one or more operator input mechanisms 312 can include, for example, a joystick, throttle control mechanism, pedal, lever, switch, or other control mechanism. The operator input mechanisms 312 are located within the cab 110 of the excavator 100 and can be used to control the movement of the excavator 100 as well as the position of the work implement by adjusting the hydraulic cylinders 114, 118, 122.

The control system 300 can further include an operating mode selector 314 in communication with the controller 210. In one example, the operating mode selector 314 is located in the cab 110 of the excavator 100. Different operations require different movement speeds. For example, certain operations, such as digging in close proximity to a pipe, require precision or fine control over the movement of the work implement. As such, a high resolution of movement rates of the respective components is desired. In another example, such as moving dirt to a truck for removal, it is desired to provide a higher rate of movement to reduce cycle times. As such, a lower resolution or gross resolution of movement rates would be desired. Accordingly, the operating mode selector 314 can allow an operator to select between a normal operating mode, a slow or precision mode that reduces the movement speed of the work implement, and a fast or productivity mode that increases the movement speed of the work implement.

Figure 4:
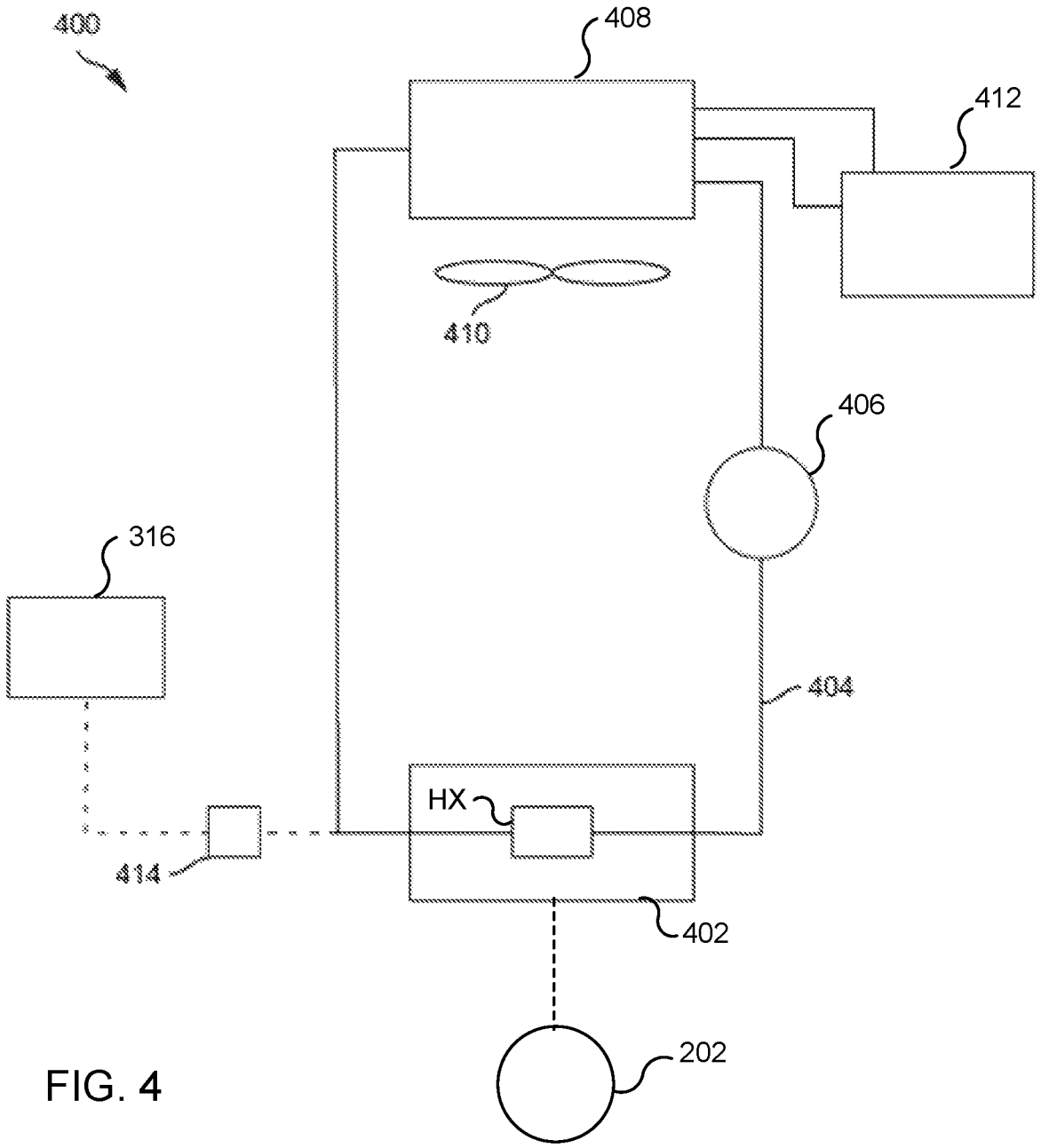
FIG. 4 is a schematic of a portion of an exemplary coolant system for the industrial machine of FIG. 1.

The controller 210 is also in communication with an engine control unit ("ECU") 316. The ECU 316 receives information from engine-specific inputs, for example using sensors or other monitoring devices. The ECU 316 can be in communication with the engine coolant system 400. An exemplary schematic of the coolant system 400 is shown in FIG. 4. A basic layout of a portion of the coolant system 400 is shown for clarity and one of ordinary skill in the art will understand that different inputs and outputs can be associated with the coolant system 400.

The coolant system 400 uses coolant to remove heat from a refrigeration load, for example the engine 402 of the excavator 100. Coolant is circulated in a refrigeration conduit 404 by a refrigeration pump 406. The coolant enters a heat exchanger HX in the engine 402 where it absorbs heat. The coolant then exits the engine 402 and is directed to a radiator 408. The coolant circulates through the radiator 408 where it expels heat to the atmosphere. A fan 410 can force air circulation over the radiator 408 to increase the heat transfer from the radiator 408 to the atmosphere. A coolant reservoir 412 is in communication with the radiator 408 to receive and store excess coolant. One or more sensors 414 are used to monitor the coolant temperature and to transmit the coolant temperature to the ECU 316 or directly with the controller 210. The sensor 414 is positioned to monitor the temperature of the coolant as it exits the engine 402 and before it enters the radiator 408. In alternative embodiments, the temperature sensor 414 can be positioned to monitor the coolant at other positions or to monitor the temperature of other components, either in the coolant system 400 or for other engine components or fluids and still be considered a coolant system 400 temperature sensor 414. More than one sensor may also be used to monitor the temperature of the coolant system 400 or the engine 402 and to transmit that data to the ECU 316.

While the coolant system 400 helps keep the engine 402 at a safe operating temperature, in certain conditions, continued operation can cause the engine 402 to overheat. Overheating conditions can be more common at higher altitudes due to decreased barometric pressure which affects the effectiveness of the coolant. Accordingly, there can be a need to reduce the heat generated by the engine 402. One way to decrease the generated heat is to reduce the demand on the engine 402. In certain systems the largest load on the engine 402 can come from the hydraulic system 200. Engine demand can therefore be reduced by derating the flow of the pump 202 so that movement speeds of the actuators 208 are reduced. This reduces the overall work load on the engine and helps to control the coolant temperature.

Figure 5:
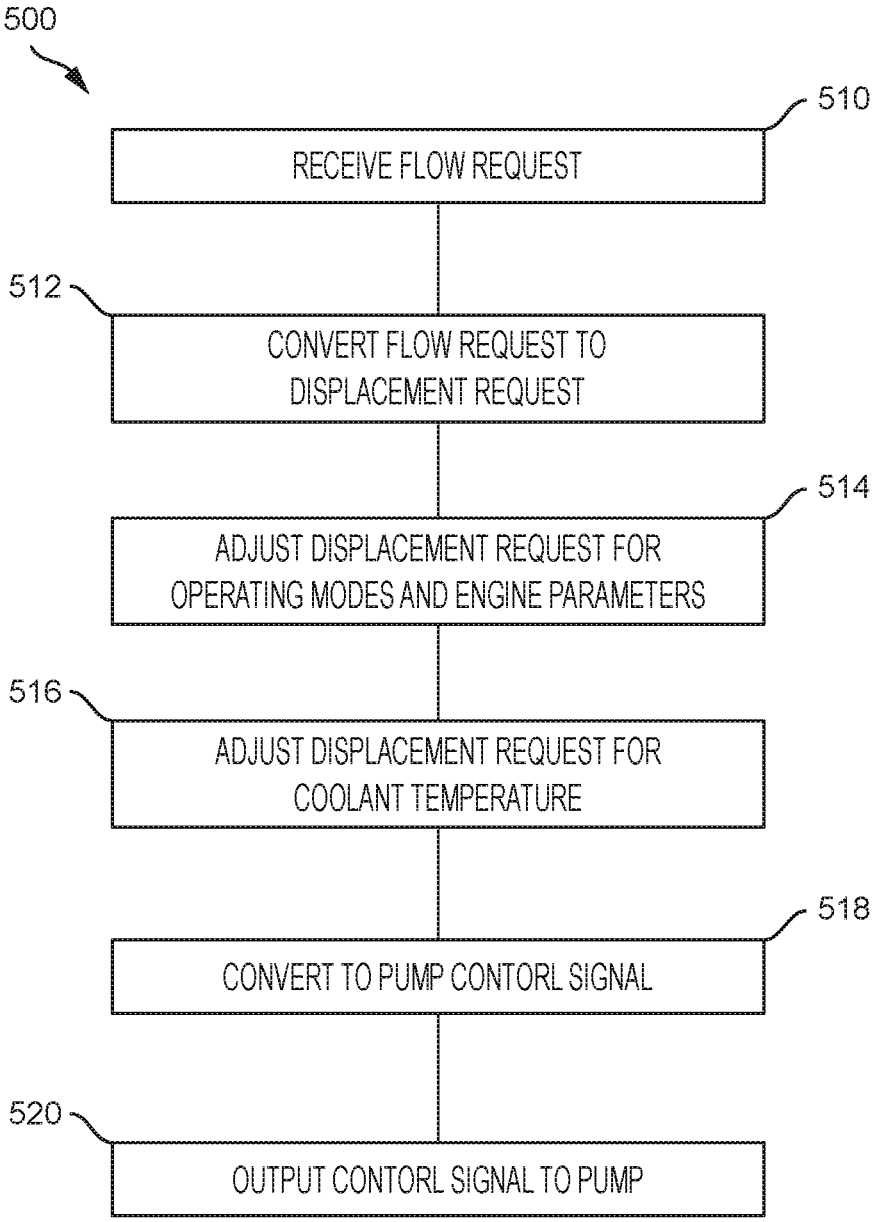
FIG. 5 is a flow chart of an exemplary control sequence for the hydraulic system.

In an exemplary embodiment, the controller 210 is configured to derate the flow of the pump 202 based on a temperatures associated with the coolant system 400, for example the engine coolant temperature. FIG. 5 shows a partial flow diagram of a flow derating module 500 to be executed by the controller 210. The controller 210 receives a flow request (step 510) during operation of the machine. The flow request can be at least partially based on the signal sent by the load sensing system 212 and information received from one or more operator input mechanisms 312. The flow request is converted to a displacement request (step 512). The displacement request can be adjusted based on an operating mode selected by the user and/or based on predefined vehicle parameters to create an adjusted displacement request (step 514). In certain instances, the adjusted displacement request can equal the displacement request (i.e. when in a normal operating mode and no other engine parameters affect the displacement request). The adjusted displacement request can then be further modified based on the engine coolant temperature, which is received from the coolant temperature sensor 414, to create a temperature adjusted displacement request (step 516). The temperature adjusted displacement request 516 is converted to a pump control signal 518 and transmitted in step 520 to the pump 202. Although a specific order is listed for these steps, they may be performed in a different order between the receiving step 510 and the transmitting step 520 as would be understood by one of ordinary skill in the art.

To create the temperature adjusted displacement request 516, the controller 210 uses a stored lookup table to determine a derate value for the hydraulic system based on the coolant temperature. An example of a lookup table is shown in FIG. 6, where X represents the set temperature value. If the coolant temperature is above a set temperature value, the adjusted displacement request is derated by a certain percentage which increases from the set temperature value until it reaches a maximum amount.

The set temperature value will vary depending on the machine or vehicle. The set temperature value can be below a critical temperature value (e.g. overheat or redline temperature) of the engine or coolant. In an exemplary embodiment, a system is configured to operate at a coolant temperature up to 110° C. with the set temperature value approximately 101° C.

In an exemplary embodiment the flow is derated from approximately 1 percent at the set temperature value to a maximum of approximately 10 percent if the coolant temperature remains above the set temperature value. Additionally, the derate amount can be increased continuously or in set increments. The increments can be an approximately 1 percent increase at each increment. For example, the derate amount can start at approximately 1 percent and increase by 1 percent for every degree of temperature increase above 101° C. until reaching a maximum value of 10 percent derate.

Derating the flow between 1-10 percent has been found to sufficiently reduce engine demand to keep operating temperatures in safe conditions, while having a minimal impact on the operator's perception on performance.

The foregoing detailed description of the certain exemplary embodiments has been provided for the purpose of explaining the general principles and practical application, thereby enabling others skilled in the art to understand the disclosure for various embodiments and with various modifications as are suited to the particular use contemplated. This description is not necessarily intended to be exhaustive or to limit the disclosure to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present disclosure, and are not intended to limit the structure of the exemplary embodiments of the present disclosure to any particular position or orientation. Terms of degree, such as "substantially" or "approximately" are understood by those of ordinary skill to refer to reasonable ranges outside of the given value, for example, general tolerances or resolutions associated with manufacturing, assembly, and use of the described embodiments and components.

What is claimed:

1. A work machine comprising:

a mechanical arm;

a hydraulic actuator coupled to the mechanical arm to move the arm between a first position and a second position;

a valve in fluid communication with the hydraulic actuator for supplying fluid to the hydraulic actuator;

a pump configured to discharge fluid to the valve;

an engine operatively connected to the pump;

a coolant system in thermal communication with the engine and including a temperature sensor; and a controller in communication with the pump and the temperature sensor, wherein the controller is configured to transmit a control signal to the pump to modify a flowrate of the pump, and wherein the controller is configured to derate the flowrate of the pump in response to a signal from the temperature sensor that a temperature is at or above a set temperature value, and wherein the derate amount increases as the temperature increases until reaching a pre-programmed maximum derate amount of approximately 10 percent of the flowrate.

2. The machine of claim 1, wherein the controller is configured to derate the flowrate of the pump a first amount at the set temperature and to derate the flowrate of the pump a second amount above the set temperature, wherein the first amount is approximately 1 percent of the flowrate and the second amount is between approximately 2 percent and approximately 10 percent of the flowrate.

3. The machine of claim 1, wherein the controller transmits the control signal to a flow control valve associated with the pump.

4. The machine of claim 1, wherein the coolant system includes a coolant and the set temperature value is associated with the temperature of the coolant.

5. The machine of claim 4, wherein the coolant system includes a radiator and the temperature sensor is configured to monitor the temperature of the coolant downstream of the engine and upstream of the radiator.

6. The machine of claim 1, wherein the set temperature value is below a critical temperature value.

7. The machine of claim 1, wherein the mechanical arm is connected to a work implement.

8. The machine of claim 1, wherein the controller is an engine control unit.

9. A work machine comprising:

a mechanical arm;

a hydraulic actuator coupled to the mechanical arm to move the arm between a first position and a second position;

a valve in fluid communication with the hydraulic actuator for supplying fluid to the hydraulic actuator;

a pump configured to discharge fluid to the valve;

an engine operatively connected to the pump;

a coolant system in thermal communication with the engine and including temperature sensor; and a controller in communication with the pump and the temperature sensor, wherein the controller is configured to transmit a control signal to the pump to modify a flowrate of the pump, and wherein the controller is configured to adjust the flowrate of the pump between approximately 1 percent and approximately 10 percent in response to a signal from the temperature sensor that a temperature is at or above a set temperature value, wherein approximately 10 percent is a pre-programmed maximum derate value.

10. The machine of claim 9, wherein the derate amount increases continuously between approximately 1 percent and approximately 10 percent as the temperature rises above the set temperature.

11. The machine of claim 9, wherein the derate amount increases in increments of approximately 1 percent between approximately 1 percent and approximately 10 percent.

12. The machine of claim 9, wherein the coolant system includes a coolant and the set temperature value is associated with the temperature of the coolant.

13. The machine of claim 9, wherein the set temperature value is below a critical temperature value.

14. A method of reducing operating temperature of a work machine, the work machine including an engine, a coolant system, a temperature sensor, a hydraulic actuator, a hydraulic pump, and a controller for controlling the flow of the hydraulic pump, the method comprising:

receiving a flow request for the hydraulic pump;

converting the flow request to a pump displacement request associated with a hydraulic flow rate;

receiving a temperature value from the temperature sensor;

derating the pump displacement request when the temperature value is at or above a set temperature value to adjust the hydraulic flow, and capping the derating at a maximum amount of approximately 10 percent;

converting the adjusted pump displacement request to a pump control signal; and outputting the pump control signal to the hydraulic pump.

15. The method of claim 14, wherein the set temperature value is below a critical temperature value.

16. The method of claim 14, wherein the temperature value is a coolant temperature.

17. The method of claim 14, wherein the hydraulic flow is derated between approximately 1 percent and approximately 10 percent.

18. The method of claim 14, wherein the flow request is at least partially based on a signal from a load sensing system.

19. The method of claim 14, further comprising adjusting the displacement request based on an operating mode input from a user.

* * * * *